US010962006B2

(12) United States Patent
Kim et al.

(10) Patent No.: US 10,962,006 B2
(45) Date of Patent: Mar. 30, 2021

(54) SCROLL COMPRESSOR WITH IMPROVED SCROLL CURVES

(71) Applicant: Samsung Electronics Co., Ltd., Suwon-si (KR)

(72) Inventors: Eun-suk Kim, Yongin-si (KR); Byung-gu Kim, Suwon-si (KR); Do-hyun Kim, Suwon-si (KR); Yang-sun Kim, Anyang-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 283 days.

(21) Appl. No.: 16/013,104

(22) Filed: Jun. 20, 2018

(65) Prior Publication Data

US 2019/0072092 A1 Mar. 7, 2019

(30) Foreign Application Priority Data

Sep. 1, 2017 (KR) ..... 10-2017-0111657

(51) Int. Cl.
*F04C 18/02* (2006.01)

(52) U.S. Cl.
CPC ..... *F04C 18/0269* (2013.01); *F04C 18/0215* (2013.01); *F04C 2250/20* (2013.01)

(58) Field of Classification Search
CPC ..... F04C 18/0269; F04C 18/0215
See application file for complete search history.

(56) References Cited

U.S. PATENT DOCUMENTS 5,318,424 A 6/1994 Bush et al.
6,430,959 B1 * 8/2002 Lifson ..... F04C 18/0269 62/468
6,527,526 B2 3/2003 Chang et al.
(Continued)

FOREIGN PATENT DOCUMENTS

EP 2 484 909 A1 8/2012
JP 2005-273453 10/2005
(Continued)

OTHER PUBLICATIONS

Machine translation of Japanese Patent Publication JP5166327B2 by TSPJPEB, Inventor Susumu et al, published on Mar. 21, 2013. (Year: 2013).*

(Continued)

*Primary Examiner* — Mary Davis
(74) *Attorney, Agent, or Firm* — Staas & Halsey LLP

(57) ABSTRACT

A scroll compressor includes a fixed scroll including a fixed mirror-like surface and a fixed wrap that is extended from the fixed mirror-like surface, formed in a hybrid curve, and includes a thick portion thicker than other portions; an orbiting scroll including an orbiting mirror-like surface and an orbiting wrap extended from the orbiting mirror-like surface and formed in a hybrid curve; and a rotating shaft configured to rotate the orbiting scroll, wherein the orbiting scroll revolves relative to the fixed scroll. A center of a curve of a center portion of the fixed wrap is located at a position offset by a predetermined distance in a direction of reducing a thickness of the thick portion of the fixed wrap from a center of the fixed mirror-like surface, and a center of a curve of a center portion of the orbiting wrap is offset to correspond to the fixed wrap.

13 Claims, 14 Drawing Sheets

(56) References Cited

U.S. PATENT DOCUMENTS

| | | | | |
|---|---|---|---|---|
| 6,736,622 | B1 | 5/2004 | Bush et al. | |
| 9,163,632 | B2 * | 10/2015 | Katou | F04C 18/0269 |
| 10,077,922 | B2 * | 9/2018 | Fujitaka | F04C 18/0269 |
| 2002/0071780 | A1 | 6/2002 | Chang et al. | |
| 2014/0363325 | A1 * | 12/2014 | Park | F04C 18/0215<br>418/55.1 |
| 2016/0146206 | A1 | 5/2016 | Choi et al. | |

FOREIGN PATENT DOCUMENTS

| | | |
|---|---|---|
| JP | 2006-37867 | 2/2006 |
| JP | 2009-174406 | 8/2009 |
| JP | 2011-74884 | 4/2011 |
| JP | 2012-36825 | 2/2012 |
| JP | 5166327 | 3/2013 |
| KR | 10-0313894 | 10/2001 |
| KR | 10-0421856 | 3/2004 |
| KR | 10-0743795 | 7/2007 |
| KR | 10-2013-0102357 | 9/2013 |
| KR | 10-2015-0051536 | 5/2015 |
| KR | 10-2016-0060918 | 5/2016 |

OTHER PUBLICATIONS

International Search Report and Written Opinion dated Dec. 4, 2018 in International Patent Application No. PCT/KR2018/008885.
Extended European Search Report dated Feb. 4, 2020 in European Patent Application No. 18850684.4.
James W. Bush et al., "Maximizing Scroll Compressor Displacement Using Generalized Wrap Geometry", International Compressor Engineering Conference, Purdue University, 1994, pp. 205-210.

* cited by examiner

FIG. 7

| CURVE OF CENTER PORTION | PART | DIVISION | PRIOR ART RELATED FORMULA<br>CENTER OF CURVE/ORIGINAL POINT (0, 0)<br>FS/OS CENTER = CENTER OF CURVE | | PRESENT DISCLOSURE RELATED FORMULA<br>CENTER OF CURVE/ORIGINAL POINT (m, n)<br>FS/OS CENTER ≠ CENTER OF CURVE | |
|---|---|---|---|---|---|---|
| INVOLUTE | FS | Inner | $x = a\cos\phi' + a\phi'\sin\phi' + \xi_1 \sin\phi'$<br>$y = a\sin\phi' - a\phi'\cos\phi' - \xi_1 \cos\phi'$ | $\xi_1 + \xi_2 = \varepsilon$ | $x = a\cos\phi' + a\phi'\sin\phi' + \xi_1 \sin\phi' + m$<br>$y = a\sin\phi' - a\phi'\cos\phi' - \xi_1 \cos\phi' + n$ | $\xi_1 + \xi_2 = \varepsilon$<br>$\sqrt{m^2 + n^2} \leq \frac{\varepsilon}{2}$ |
| | OS | Outer | $x = a\cos\phi' + a\phi'\sin\phi' - \xi_2 \sin\phi'$<br>$y = a\sin\phi' - a\phi'\cos\phi' + \xi_2 \cos\phi'$ | | $x = a\cos\phi' + a\phi'\sin\phi' - \xi_2 \sin\phi' + m$<br>$y = a\sin\phi' - a\phi'\cos\phi' + \xi_2 \cos\phi' + n$ | |
| LOGARITHMIC SPIRAL | FS | Inner | $x = a\phi^k \cos\phi + \xi_1 \cos\left[\phi - \tan^{-1}\left(\frac{k}{\phi}\right)\right]$<br>$y = a\phi^k \sin\phi + \xi_1 \sin\left[\phi - \tan^{-1}\left(\frac{k}{\phi}\right)\right]$ | $\xi_1 + \xi_2 = \varepsilon$ | $x = a\phi^k \cos\phi + \xi_1 \cos\left[\phi - \tan^{-1}\left(\frac{k}{\phi}\right)\right] + m$<br>$y = a\phi^k \sin\phi + \xi_1 \sin\left[\phi - \tan^{-1}\left(\frac{k}{\phi}\right)\right] + n$ | $\xi_1 + \xi_2 = \varepsilon$<br>$\sqrt{m^2 + n^2} \leq \frac{\varepsilon}{2}$ |
| | OS | Outer | $x = a\phi^k \cos\phi - \xi_2 \cos\left[\phi - \tan^{-1}\left(\frac{k}{\phi}\right)\right]$<br>$y = a\phi^k \sin\phi - \xi_2 \sin\left[\phi - \tan^{-1}\left(\frac{k}{\phi}\right)\right]$ | | $x = a\phi^k \cos\phi - \xi_2 \cos\left[\phi - \tan^{-1}\left(\frac{k}{\phi}\right)\right] + m$<br>$y = a\phi^k \sin\phi - \xi_2 \sin\left[\phi - \tan^{-1}\left(\frac{k}{\phi}\right)\right] + n$ | |

SCROLL COMPRESSOR WITH IMPROVED SCROLL CURVES

CROSS-REFERENCE TO RELATED APPLICATIONS

This application is based on and claims priority under 35 U.S.C. § 119 to Korean Patent Application No. 10-2017-0111657, filed on Sep. 1, 2017, in the Korean Intellectual Property Office, the disclosure of which is incorporated by reference herein in its entirety.

BACKGROUND

1. Field

The present disclosure relates to a scroll compressor, and more particularly to a scroll compressor having a reinforced wrap.

2. Description of the Related Art

A scroll compressor is a device that has a fixed scroll and an orbiting scroll each having a spiral wrap which are engaged with each other and compresses refrigerant by rotating the orbiting scroll relative to the fixed scroll.

The scroll compressor has a plurality of compression portions formed by the fixed scroll fixed within a hermetic container and the orbiting scroll rotating against the fixed scroll. The plurality of compression portions gradually narrows from the outer peripheral side toward the center by the rotation of the orbiting scroll. The refrigerant is sucked into a compression portion located at the outer peripheral side, and is compressed while the compression portion is moving toward the center by the rotation of the orbiting scroll. When the compression portion is located at the center, the refrigerant compressed to the maximum is discharged from the compression portion into the hermetic container.

Due to recent energy regulations, it is common in air conditioner companies to use a scroll compressor using BLDC motor (Brushless DC motor). In addition, there is a tendency to increase the price competitiveness of the air conditioner by reducing the number of compressors by increasing the capacity and speed of the scroll compressor.

There are various methods of maximizing the amount of refrigerant to be compressed while maintaining the external size of the scroll compressor, that is, methods of maximizing the compression capacity of the scroll compressor in a limited space. One of these methods is to form the wrap of the fixed scroll and the wrap of the orbiting scroll in a hybrid wrap. The hybrid wrap is a combination of various types of curved surfaces. The outermost surface of the hybrid wrap is formed as an arc surface, so that the compression capacity may be maximized more than other types of wraps.

However, the larger the compression capacity is designed, the smaller the wrap thickness of the outermost portion of the scroll compressor using such a hybrid wrap. When the wrap thickness is reduced, there is a problem that the reliability of the scroll compressor is lowered, for example, cracks are generated in the wrap when the scroll compressor is speeded up.

Therefore, it is required to develop a scroll compressor capable of improving the reliability of the wrap while maximizing the compression capacity of the scroll compressor in a limited space.

SUMMARY

The present disclosure has been developed in order to overcome the above drawbacks and other problems associated with the conventional arrangement. An aspect of the present disclosure relates to a scroll compressor capable of improving reliability while maximizing a compression capacity in a limited space.

According to an aspect of the present disclosure, a scroll compressor may include a fixed scroll including a fixed mirror-like surface and a fixed wrap that is extended from the fixed mirror-like surface, is formed in a hybrid curve, and includes a thick portion that is thicker than other portions; an orbiting scroll including an orbiting mirror-like surface and an orbiting wrap that is extended from the orbiting mirror-like surface and is formed in a hybrid curve; and a rotating shaft configured to rotate the orbiting scroll, wherein the orbiting scroll revolves relative to the fixed scroll, wherein a center of a curve of a center portion of the fixed wrap is located at a position that is offset by a predetermined distance in a direction of reducing a thickness of the thick portion of the fixed wrap from a center of the fixed mirror-like surface, and wherein a center of a curve of a center portion of the orbiting wrap is offset to correspond to the fixed wrap.

The center of the curve of the center portion of the fixed wrap may be offset from the center of the fixed mirror-like surface by ½ or less of an eccentric distance between a center line of the rotating shaft and a center of the orbiting mirror-like surface of the orbiting scroll.

The center of the curve of the center portion of the fixed wrap may be located at a position that is offset from the center of the fixed mirror-like surface in a direction in which the thickness of the thick portion of the fixed wrap is reduced and a thickness of a suction portion of the fixed wrap is increased.

The hybrid curve forming each of the fixed wrap and the orbiting wrap may include an involute curve, at least one multidimensional curve, and at least one arc connected sequentially outward from the center portion.

The hybrid curve forming each of the fixed wrap and the orbiting wrap may include a logarithmic spiral curve, at least one multidimensional curve, and at least one arc connected sequentially outward from the center portion.

The scroll compressor of claim 1, wherein the hybrid curve forming each of the fixed wrap and the orbiting wrap comprises at least one multidimensional curve and at least one arc connected sequentially outward from the center portion.

The center of the curve of the center portion of the fixed wrap may be located at a position that is offset from the center of the fixed mirror-like surface in a direction in which the thickness of the thick portion of the fixed wrap is reduced and a thickness of the center portion of the fixed wrap is increased.

According to another aspect of the present disclosure, a scroll compressor may include a first scroll including a fixed mirror-like surface and a first wrap extended from the fixed mirror-like surface; a second scroll including an orbiting mirror-like surface and a second wrap extended from the orbiting mirror-like surface; and a rotating shaft configured to cause the second scroll to revolve relative to the first scroll, wherein the first wrap is formed of an inner curve and an outer curve which are hybrid curves and includes a thin suction portion and a middle portion thicker than the suction portion, wherein a center of a curve of a center portion of the inner curve is offset by a predetermined distance from a center of the fixed mirror-like surface so that a portion of the inner curve of the middle portion of the first wrap is close to a portion of the outer curve of the middle portion, and wherein the second wrap includes an inner curve and an outer curve which are hybrid curves, and is formed to correspond to the inner curve of the first wrap.

Other objects, advantages and salient features of the present disclosure will become apparent from the following detailed description, which, taken in conjunction with the annexed drawings, discloses preferred embodiments.

BRIEF DESCRIPTION OF THE DRAWINGS

These and/or other aspects and advantages of the present disclosure will become apparent and more readily appreciated from the following description of the embodiments, taken in conjunction with the accompanying drawings of which:

FIG. 7 is a table illustrating examples of formulas of a curve of a center portion of a fixed wrap of a fixed scroll and a curve of a center portion of an orbiting wrap of an orbiting scroll and their centers;

DETAILED DESCRIPTION OF THE EXEMPLARY EMBODIMENTS

Hereinafter, certain exemplary embodiments of the present disclosure will be described in detail with reference to the accompanying drawings.

The matters defined herein, such as a detailed construction and elements thereof, are provided to assist in a comprehensive understanding of this description. Thus, it is apparent that exemplary embodiments may be carried out without those defined matters. Also, well-known functions or constructions are omitted to provide a clear and concise description of exemplary embodiments. Further, dimensions of various elements in the accompanying drawings may be arbitrarily increased or decreased for assisting in a comprehensive understanding.

The terms "first", "second", etc. may be used to describe diverse components, but the components are not limited by the terms. The terms are only used to distinguish one component from the others.

The terms used in the present application are only used to describe the exemplary embodiments, but are not intended to limit the scope of the disclosure. The singular expression also includes the plural meaning as long as it does not differently mean in the context. In the present application, the terms "include" and "consist of" designate the presence of features, numbers, steps, operations, components, elements, or a combination thereof that are written in the specification, but do not exclude the presence or possibility of addition of one or more other features, numbers, steps, operations, components, elements, or a combination thereof.

Figure 1:
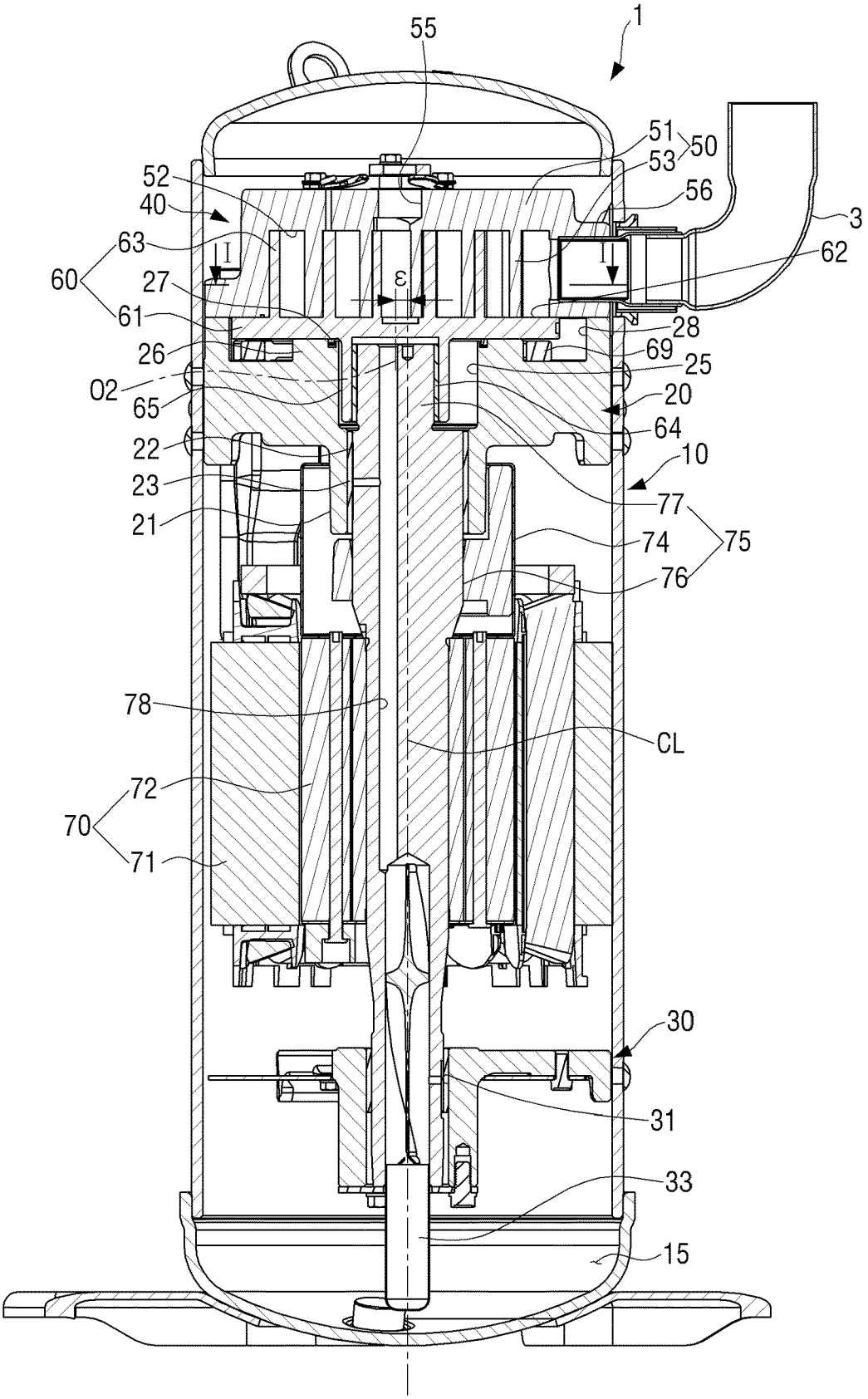
FIG. 1 is a longitudinal sectional view illustrating a scroll compressor according to an embodiment of the present disclosure.

FIG. 1 is a longitudinal sectional view illustrating a scroll compressor according to an embodiment of the present disclosure.

Referring to FIG. 1, a scroll compressor 1 according to an embodiment of the present disclosure may include a casing 10, a main frame 20, a sub frame 30, a compression mechanism 40, and a drive motor 70.

The casing 10 is a hermetic container having a cylindrical shape. The compression mechanism 40, the main frame 20, the sub frame 30, and the drive motor 70 are accommodated in the casing 10.

The main frame 20 and the sub frame 30 are fixed in the casing 10 at a predetermined interval in the vertical direction. The drive motor 70 is rotatably disposed between the main frame 20 and the sub frame 30.

The casing 10 is provided with a suction pipe 3 through which refrigerant gas is drawn. The suction pipe 3 passes through the casing 10, and one end of the suction pipe 3 is connected to the compression mechanism 40. The casing 10 is provided with a discharge pipe (not illustrated) for discharging the compressed refrigerant to the outside.

The compression mechanism 40 is provided at the upper side of the main frame 20 and an oil reservoir 15 in which oil or lubricant for lubricating and cooling the internal components is stored is provided at the lower side of the casing 10 below the sub frame 30.

The main frame 20 is formed in a substantially disc shape, and a protrusion 21 is formed on a bottom surface of the main frame 20. A shaft support hole 22 is formed in the protrusion 21 of the main frame 20 and a bearing metal 23 is press-fitted into the shaft support hole 22. A rotating shaft 75 is inserted into the bearing metal 23 and the bearing metal 23 supports the rotation of the rotating shaft 75. A boss insertion groove 25 having an inner diameter larger than the inner diameter of the shaft support hole 22 is provided on the upper side of the shaft support hole 22.

An annular protrusion 26 forming the top end of the boss insertion groove 25 is provided on the top surface of the main frame 20. The top surface of the annular protrusion 26 forms a mirror-like surface to be in contact with and support an orbiting scroll 60.

Further, an oil ring 27 is provided on the top surface of the annular protrusion 26 and surrounds the boss insertion groove 25. An annual groove 28 is provided outside the annular protrusion 26. The annual groove 28 forms a back pressure chamber. The back pressure chamber 28 is filled with the oil supplied from the oil reservoir 15.

In addition, an Oldham ring 69 is provided in the back pressure chamber 28 between the orbiting scroll 60 and the main frame 20 to prevent the orbiting scroll 60 from rotating on its own axis.

The compression mechanism 40 includes a fixed scroll 50 and the orbiting scroll 60.

The fixed scroll 50 is disposed on the upper side of the main frame 20 and the orbiting scroll 60 is accommodated in a space formed by the fixed scroll 50 and the main frame 20. The orbiting scroll 60 meshes with the fixed scroll 50 and is disposed between the fixed scroll 50 and the main frame 20 so as to revolve relative to the fixed scroll 50.

The fixed scroll 50 includes a body portion 51 and a fixed wrap 53. The body portion 51 is formed in a certain shape corresponding to the inner surface of the casing 10 and has a fixed mirror-like surface 52 formed on a surface facing the orbiting scroll 60. The fixed wrap 53 is formed in a hybrid curved surface extending vertically from the fixed mirror surface 52 of the body portion 51 and having predetermined thickness and height. A discharge port 55 penetrating the body portion 51 is formed at the center of the body portion 51. A suction port 56 is formed at a side surface of the body portion 51. The suction port 56 is connected to the suction pipe 3 through which the refrigerant is drawn. The fixed wrap 53 of the fixed scroll 50 will be described in detail below.

The orbiting scroll 60 includes a mirror-like plate 61, an orbiting wrap 63, and a boss portion 65.

The mirror-like plate 61 is formed in a shape of a disc having predetermined thickness and area and has an orbiting mirror-like surface 62 formed on the surface facing the fixed scroll 50. The orbiting wrap 63 is formed in a hybrid curved surface extending vertically from the orbiting mirror-like surface 62 of the mirror-like plate 61 and having predetermined thickness and height. The orbiting wrap 63 is formed to engage with the fixed wrap 53 of the fixed scroll 50. The boss portion 65 is formed at the center of the opposite surface of the mirror-like plate 61. The orbiting wrap 63 of the orbiting scroll 60 will be described in detain below.

The orbiting wrap 63 of the orbiting scroll 60 is engaged with the fixed wrap 53 of the fixed scroll 50 and the boss portion 65 is inserted into the boss insertion groove 25 of the main frame 20. The surface of the mirror-like plate 61 on which the boss portion 65 is formed is supported by the mirror-like surface of the main frame 20. Therefore, the surface of the mirror-like plate 61 supported by the mirror-like surface of the main frame 20 also forms a mirror-like surface.

A plurality of compression portions 41 formed by the fixed wrap 53 of the fixed scroll 50 and the orbiting wrap 63 of the orbiting scroll 60 form a compression chamber for compressing the refrigerant sucked through the suction port 56.

The drive motor 70 includes a stator 71 and a rotor 72. The stator 71 is fixed to the inner surface of the casing 10. The rotor 72 is rotatably inserted into the stator 71. Further, the rotating shaft 75 is inserted through the rotor 72.

The rotating shaft 75 includes a shaft portion 76 having a predetermined length and an eccentric portion 77 extending upward from one end of the shaft portion 76.

The shaft portion 76 of the rotating shaft 75 is fixed to the rotor 72 of the drive motor 70 and an end part of the shaft portion 76 is supported by the bearing metal 23 inserted into the protrusion 21 of the main frame 20.

The eccentric portion 77 of the rotating shaft 75 is inserted into the boss portion 65 of the orbiting scroll 60. A bearing metal 64 is also provided between the eccentric portion 77 of the rotating shaft 75 and the boss portion 65 of the orbiting scroll 60.

A balance weight 74 is provided on the shaft portion 76 of the rotating shaft 75 above the rotor 72. The lower portion of the shaft portion 76 is supported by a bearing metal 31 provided in the sub frame 30.

The rotating shaft 75 is provided with an oil passage 78 penetrating the shaft portion 76 and the eccentric portion 77. The lower end 33 of the rotating shaft 75 is submerged in the oil reservoir 15 of the casing 10. When the rotating shaft 75 rotates, the oil stored in the oil reservoir 15 is supplied to the boss portion 65 of the orbiting scroll 60 and the bearing metal 23 of the main frame 20 through the oil passage 78 of the rotating shaft 75 by the pressure acting on the oil reservoir 15.

Hereinafter, the fixed wrap 53 of the fixed scroll 50 and the orbiting wrap 63 of the orbiting scroll 60 will be described in detail with reference to FIG. 2.

Figure 2:
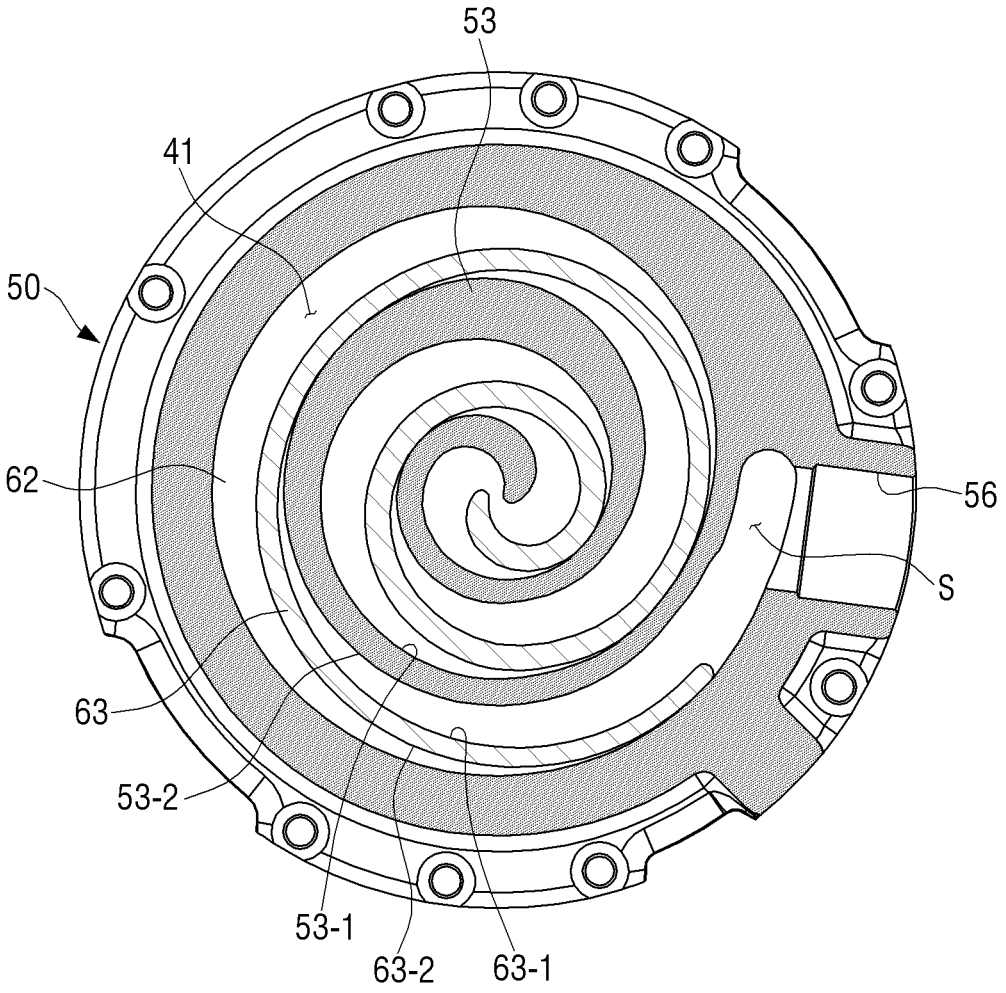
FIG. 2 is a cross-sectional view illustrating the scroll compressor of FIG. 1 taken along line I-I.

FIG. 2 is a cross-sectional view illustrating the scroll compressor of FIG. 1 taken along line I-I.

Referring to FIGS. 1 and 2, the fixed scroll 50 may include the fixed wrap 53 extending vertically downwardly from the fixed mirror-like surface 52 of the body portion 51. Hereinafter, the fixed wrap 53 may be referred to as a first wrap if necessary.

Further, the fixed wrap 53 is formed in a curved surface extending from the central part of the body portion 51 to the outer circumference of the body portion 51. In the case of the present embodiment, the fixed wrap 53 is formed in a hybrid curved surface. Here, the hybrid curved surface refers to a curved surface in which an inner curve 53-1 and an outer curve 53-2 forming the fixed wrap 53 are hybrid curves when the fixed wrap 53 is cut in a direction parallel to the fixed mirror-like surface 52 of the body portion 51 as illustrated in FIG. 2.

On the other hand, the hybrid curve refers to a curve combining a plurality of curves. For example, the hybrid curve is a continuous curve formed by combining two or more curves of various curves such as an involute curve, a logarithmic spiral curve, a multidimensional curve, an arc, and the like.

In the case of the scroll compressor 1 according to an embodiment of the present disclosure, the hybrid curve used for the fixed wrap 53 of the fixed scroll 50 may be variously configured. However, the curve portion constituting the outermost portion of the fixed wrap 53 is constituted by an arc. When the outermost portion of the fixed wrap 53 is formed as an arc, the compression space formed by the fixed wrap 53 and the orbiting wrap 63 may be maximized, so that the suction capacity of the scroll compressor 1 may be maximized.

As an example, the hybrid curve forming the fixed wrap 53 may be composed of an involute curve, at least one multidimensional curve, and at least one arc connected sequentially outward from the center portion. In this case, the involute curve forms the center portion of the fixed wrap 53, and the arc forms the outermost portion of the fixed wrap 53. The outermost portion of the fixed wrap 53 may be formed of a single arc or two or more arcs connected to each other. The multidimensional curve smoothly connects the involute curve of the center portion and the arc of the outermost portion, and a single multidimensional curve or two or more multidimensional curves may be used. Here, the multidimensional curve refers to a two or more dimensional curve rather than an arc.

As another example, the hybrid curve forming the fixed wrap 53 may be composed of a logarithmic spiral curve, at least one multidimensional curve, and at least one arc connected sequentially outward from the center portion. In this case, the logarithmic spiral curve forms the center portion of the fixed wrap 53, and the arc forms the outermost portion of the fixed wrap 53. The outermost portion of the fixed wrap 53 may be formed of a single arc or two or more arcs connected to each other. The multidimensional curve smoothly connects the logarithmic spiral curve of the center portion and the arc of the outermost portion, and a single multidimensional curve or two or more multidimensional curves may be used.

As another example, the hybrid curve forming the fixed wrap 53 may be composed of at least one multidimensional curve and at least one arc connected sequentially outward from the center portion.

As another example, the hybrid curve forming the fixed wrap 53 may be formed by connecting a plurality of multidimensional curves outward from the center portion.

As another example, the hybrid curve forming the fixed wrap 53 may be formed by connecting a plurality of arcs outward from the center portion.

Referring to FIGS. 1 and 2, the orbiting scroll 60 may include the orbiting wrap 63 extending vertically upwardly from the orbiting mirror-like surface 62 of the mirror-like plate 61. Hereinafter, the orbiting wrap 63 may be referred to as a second wrap if necessary.

Further, the orbiting wrap 63 is formed in a curved surface extending from the central part of the mirror-like plate 61 to the outer circumference of the mirror-like plate 61. In the case of the present embodiment, the orbiting wrap 63 is formed in a hybrid curved surface to correspond to the fixed wrap 53. Here, the hybrid curved surface refers to a curved surface in which an inner curve 63-1 and an outer curve 63-2 forming the orbiting wrap 63 are hybrid curves when the orbiting wrap 63 is cut in a direction parallel to the orbiting mirror-like surface 62 as illustrated in FIG. 2.

The orbiting wrap 63 revolves while contacting the fixed wrap 53 at the inside of the fixed wrap 53 so that the outer curve 63-2 of the orbiting wrap 63 is formed to correspond to the inner curve 53-1 of the fixed wrap 53 that is in contact with the orbiting wrap 63. Therefore, when the inner curve 53-1 of the fixed wrap 53 is composed of an involute curve, at least one multidimensional curve, and at least one arc, the outer curve 63-2 of the orbiting wrap 63 may be composed of an involute curve, at least one multidimensional curve, and at least one arc.

As another example, when the inner curve 53-1 of the fixed wrap 53 is composed of a logarithmic spiral curve, at least one multidimensional curve, and at least one arc, the outer curve 63-2 of the orbiting wrap 63 may be composed of a logarithmic spiral curve, at least one multidimensional curve, and at least one arc.

Hereinafter, a fixed scroll and an orbiting scroll of a conventional scroll compressor having wraps formed of the hybrid curve will be described with reference to FIG. 3.

Figure 3:
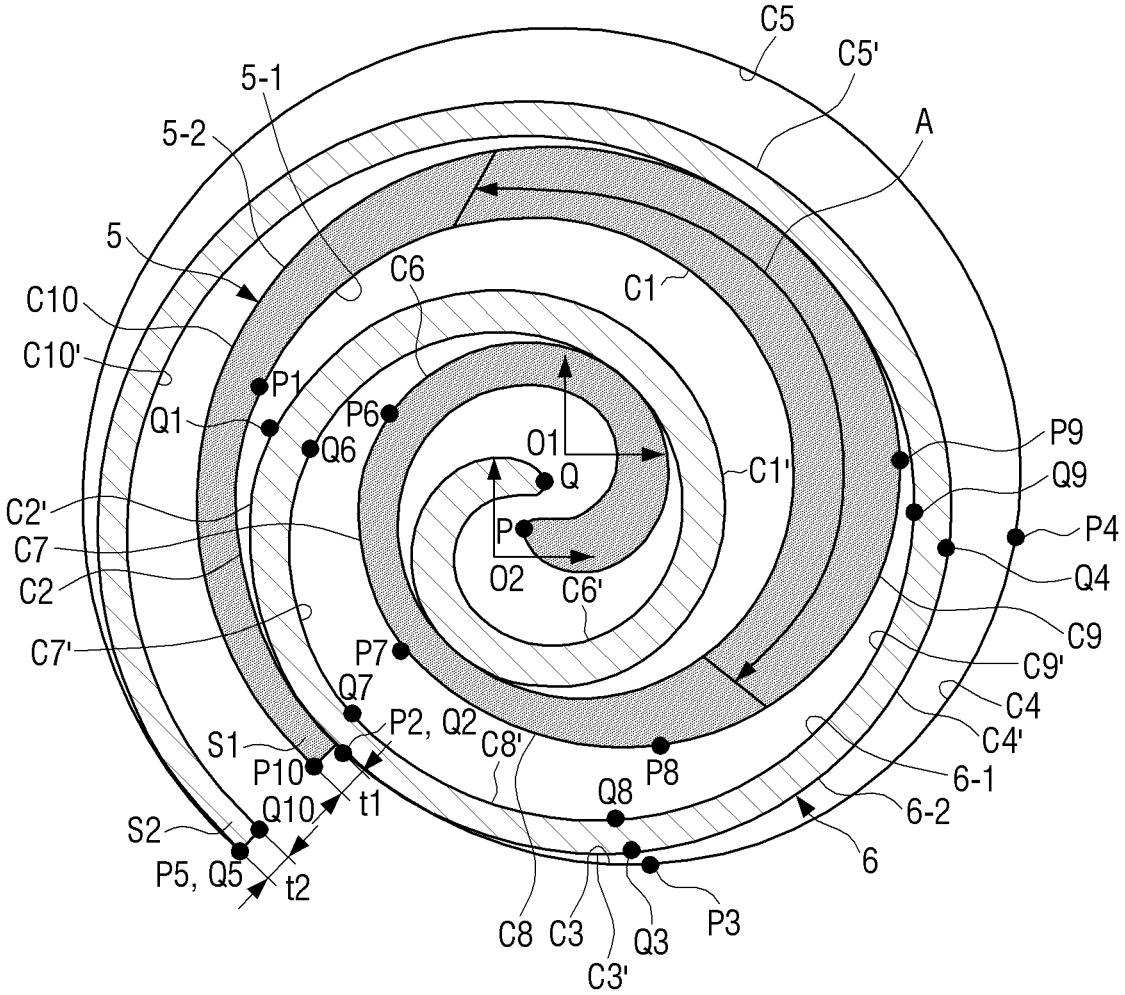
FIG. 3 is a cross-sectional view illustrating a state where a fixed scroll and an orbiting scroll of a conventional scroll compressor are engaged with each other.

FIG. 3 is a cross-sectional view illustrating a state where a fixed scroll and an orbiting scroll of a conventional scroll compressor are engaged with each other.

Referring to FIG. 3, an inner curve 5-1 and 6-1 and an outer curve 5-2 and 6-2 of each of a fixed wrap 5 of the fixed scroll and an orbiting wrap 6 of the orbiting scroll are hybrid curves composed of five curves.

In FIG. 3, the curve 1 C1 to the curve 5 C5 is a first hybrid curve forming the inner curve 5-1 of the fixed wrap 5, and the curve 6 C6 to the curve 10 C10 is a second hybrid curve forming the outer curve 5-2 of the fixed wrap 5. Here, the curve 1 C1 is the part from the start point P of the fixed wrap 5 to the point P1 on the inner curve 5-1, the curve 2 C2 is the part of the inner curve 5-1 from the point P1 to the point P2, the curve 3 C3 is the part of the inner curve 5-1 from the point P2 to the point P3, the curve 4 C4 is the part of the inner curve 5-1 from the point P3 to the point P4, and the curve 5 C5 is the part of the inner curve 5-1 from the point P4 to the point P5. The curve 6 C6 is the part from the start point P of the fixed wrap 5 to the point P6 on the outer curve 5-2, the curve 7 C7 is the part of the outer curve 5-2 from the point P6 to the point P7, the curve 8 C8 is the part of the outer curve 5-2 from the point P7 to the point P8, the curve 9 C9 is the part of the outer curve 5-2 from the point P8 to the point P9, and the curve 10 C10 is the part of the outer curve 5-2 from the point P9 to the point P10.

Further, the curve 1' C1' to the curve 5' C5' is a third hybrid curve forming the outer curve 6-2 of the orbiting wrap 6 corresponding to the inner curve 5-1 of the fixed wrap 5, and the curve 6' C6' to curve 10' C10' is a fourth hybrid curve forming the inner curve 6-1 of the orbiting wrap 6 corresponding to the outer curve 5-2 of the fixed wrap 5. Here, the curve 1' C1' is the part from the start point Q of the orbiting wrap 6 to the point Q1 on the outer curve 6-2, the curve 2' C2' is the part of the outer curve 6-2 from the point Q1 to the point Q2, the curve 3' C3' is the part of the outer curve 6-2 from the point Q2 to the point Q3, the curve 4' C4' is the part of the outer curve 6-2 from the point Q3 to the point Q4, and the curve 5' C5' is the part of the outer curve 6-2 from the point Q4 to the point Q5. The curve 6' C6' is the part from the start point Q of the orbiting wrap 6 to the point Q6 on the inner curve 6-1, the curve 7' C7' is the part of the inner curve 6-1 from the point Q6 to the point Q7, the curve 8' C8' is the part of the inner curve 6-1 from the point Q7 to the point Q8, the curve 9' C9' is the part of the inner curve 6-1 from the point Q8 to the point Q9, and the curve 10' C10' is the part of the inner curve 6-1 from the point Q9 to the point Q10.

At this time, in order to maximize the suction capacity in the limited space, the outermost curves of the fixed wrap 5 and the orbiting wrap 6 are formed as arcs. In other words, the curve 5 C5 and the curve 10 C10, which are the inner and outer curves of the outermost portion of the fixed wrap 5, are arcs. The curve 5' C5' and the curve 10' C10' corresponding to the curve 5 C5 and the curve 10 C10, which are the outer curve and the inner curve of the outermost portion of the orbiting wrap 6 being in contact with the inner curve 5-1 and the outer curve 5-2 of the fixed wrap 5, are arcs.

Further, the curve 1 C1 and the curve 6 C6, which are the inner curve and the outer curve of the center portion of the fixed wrap 5, are involute curves. At this time, the center O1 of the inner curve C1 of the central portion of the fixed wrap 5 coincides with the center of the circle corresponding to the outer circumferential surface of the fixed scroll (hereinafter, referred to as the center of the fixed scroll). Therefore, the center of the fixed scroll coincides with the center of the fixed mirror-like surface.

Referring to FIG. 3, the middle portion of the fixed wrap 5 is thicker than the center portion or the outer portion. Hereinafter, the middle portion of the fixed wrap 5 having the large thickness is referred to as a thick portion A. The thickness of the thick portion A of the fixed wrap 5 is approximately twice or more as thick as the thicknesses of the center portion and the outer portion.

The curve 1' C1' and curve 6' C6', which are the outer curve and the inner curve of the center portion of the orbiting wrap 6 corresponding to the center portion of the fixed wrap 5, are involute curves. At this time, the center O2 of the outer curve C1' of the center portion of the orbiting wrap 6 coincides with the center of the circle corresponding to the outer circumferential surface of the mirror-like plate of the orbiting scroll (hereinafter, referred to as the center of the orbiting scroll). Therefore, the center of the orbiting scroll coincides with the center of the orbiting mirror-like surface. However, the middle portion of the orbiting wrap 6 corresponding to the thick portion A of the fixed wrap 5 is not thick and has a thickness similar to the thicknesses of the center portion and the outer portion of the orbiting wrap 6.

The thickness t1 of the suction portion S1 of the fixed wrap 5 of the fixed scroll and the thickness t2 of the suction portion S2 of the orbiting warp 6 of the orbiting scroll become thinner as the suction capacity of the scroll compressor is increased. In the case where the thickness t1 of the suction portion S1 of the fixed wrap 5 and the thickness t2 of the suction portion S2 of the orbiting wrap 6 are thin, when the scroll compressor is operated at a high speed or when the liquid refrigerant flows into the compression portion, cracks may occur in the fixed wrap 5 or the orbiting wrap 6.

It is necessary to increase the thicknesses t1 and t2 of the suction portions S1 and S2 of the fixed wrap 5 and the orbiting wrap 6 to prevent such a crack from occurring. At this time, the compression capacity formed by the fixed wrap 5 and the orbiting wrap 6 needs to be maintained as it is. The present disclosure relates to a method for increasing the thicknesses t1 and t2 of the suction portion S1 of the fixed wrap 5 and the suction portion S2 of the orbiting wrap 6 while maintain the compression capacity.

Hereinafter, the fixed scroll and the orbiting scroll of the scroll compressor according to an embodiment of the present disclosure in which the suction portion of the fixed wrap and the suction portion of the orbiting wrap are thickened while maintaining the compression capacity will be described in detail with reference to FIGS. 4 to 6.

Figure 4:
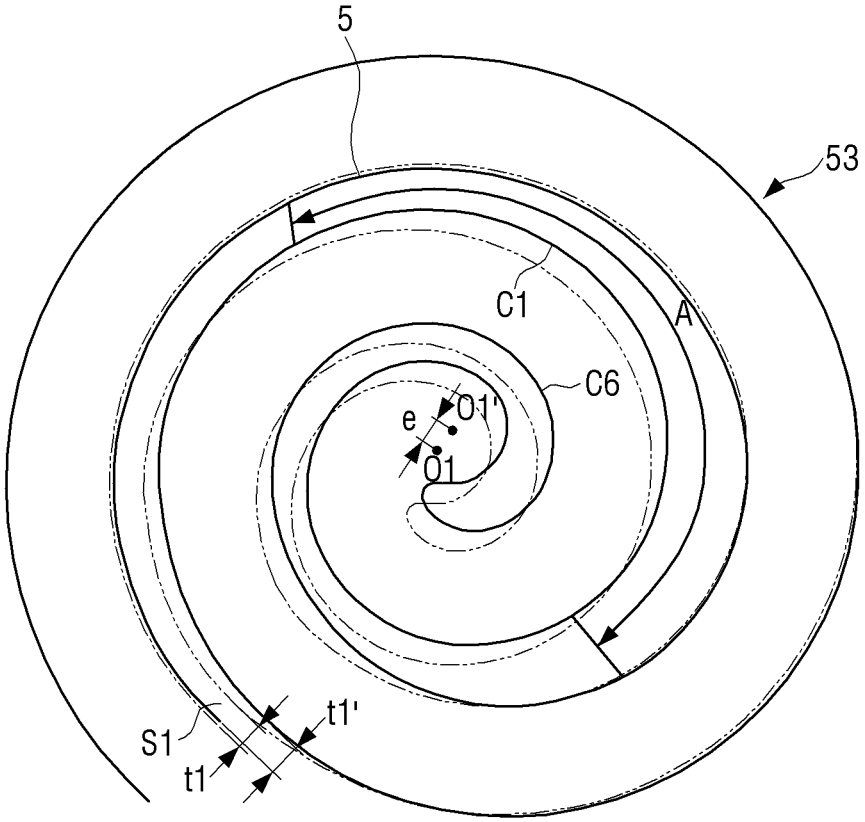
FIG. 4 is a view illustrating a comparison between a fixed wrap of a fixed scroll of a scroll compressor according to an embodiment of the present disclosure and a fixed wrap of a fixed scroll of a conventional scroll compressor.

FIG. 4 is a view illustrating a comparison between a fixed wrap of a fixed scroll of a scroll compressor according to an embodiment of the present disclosure and a fixed wrap of a fixed scroll of a conventional scroll compressor. FIG. 5 is a view illustrating a comparison between an orbiting wrap of an orbiting scroll of a scroll compressor according to an embodiment of the present disclosure and an orbiting wrap of an orbiting scroll of a conventional scroll compressor. FIG. 6 is a cross-sectional view illustrating a state where a fixed wrap of a fixed scroll and an orbiting wrap of an orbiting scroll of a scroll compressor according to an embodiment of the present disclosure are engaged with each other.

When designing the shape of the fixed wrap in a limited space, the thickness of the other portion of the fixed wrap may be made thick by thinning the thickness of any one portion of the fixed wrap. In FIG. 3, the thick portion A of the fixed wrap 5 is composed of the curve 1 C1 of the inner curve 5-1 and the curve 9 C9 and the curve 10 C10 of the outer curve 5-2. The portion of the orbiting wrap 6 that correspond to these curves is composed of the curve 1' C1' of the outer curve 6-2 and the curve 9' C9' and the curve 10' C10' of the inner curve 6-1.

At this time, when one or more of the curves C1, C9 and C10 constituting the thick portion A of the fixed wrap 5 is offset by a predetermined distance e in the direction in which the thickness of the thick portion A is reduced, the thick portion A may be thinned and other portions of the fixed wrap 5 excluding the thick portion A may be thickened. Hereinafter, the predetermined distance e by which the curve is offset is referred to as an offset amount.

For example, when the curve 1 C1 of the curves forming the thick portion A of the fixed wrap 5 is moved, that is, is offset by a predetermined distance e in the direction of thinning the thickness of the thick portion A as illustrated in FIG. 4, the thickness of the thick portion A becomes thinner and the thickness of the suction portion S1 of the fixed wrap 53 becomes thicker from t1 to t1'. In other words, when the curve 1 C1, which is the inner curve of the thick portion A of the fixed wrap 53, is moved by a predetermined distance to approach the curve 9 C9, which is the outer curve of the thick portion A of the fixed wrap 53, the thickness of the thick portion A becomes thinner and the thickness of the suction portion S1 of the fixed wrap 53 becomes thicker.

At this time, when the curve 6 C6, which is the outer curve of the center portion of the fixed wrap 53, is simultaneously offset by the predetermined distance, the thickness of the center portion of the fixed wrap 53 formed by the curve 1 C1 and the curve 6 C6 may be not changed and only the thickness of the suction portion S1 may be increased. In reference, in FIG. 4, the solid line represents the fixed wrap 53 according to the present disclosure in which the conventional fixed wrap 5 is offset in the direction of thinning the thick portion A, and the imaginary line (two-dot chain line) represents the conventional fixed wrap 5 in which the thick portion A is not offset.

Further, the plurality of curves constituting the hybrid curve satisfy the connection condition that two adjacent curves of the plurality of curves are tangent to each other at a point where the two adjacent curves meet. Therefore, when any one of the plurality of curves constituting the hybrid curve is offset by the predetermined distance, the other curves are moved correspondingly by the connection condition of the hybrid curve, so that the thickness t1' of the suction portion S1 of the fixed wrap 53 is increased as illustrated in FIG. 4.

On the other hand, when the curve 1 C1 is moved, the center O1 of the curve 1 C1 is moved. In the case of the present embodiment, since the curve 1 C1 is an involute curve, the center of the involute curve is moved. Therefore, the center O1' of the curve C1 of the center portion of the fixed wrap 53 of the fixed scroll 50 of the scroll compressor 1 according to an embodiment of the present disclosure does not coincide with the center O1 of the fixed scroll 50 and is shifted by the distance e by which the curve C1 of the center portion is moved, that is, the offset amount.

However, the offset amount e is limited by the eccentric distance ε of the orbiting scroll 60. In detail, the distance e by which the center O1' of the curve C1 of the center portion of fixed wrap 53 is offset from the center O1 of the fixed scroll 50 is ½ or less than the distance between the center line CL of the rotating shaft 75 and the center O2 of the orbiting scroll 60, that is, the eccentric distance ε of the orbiting scroll 60. When the offset amount e is larger than ½ of the eccentric distance ε of the orbiting scroll 60, the rotating stability of the orbiting scroll 60 may be deteriorated and the reverse rotation force of the orbiting scroll 60 may become large, which may damage the Oldham ring 69.

The orbiting wrap 63 of the orbiting scroll 60 is offset to correspond to the offset amount e of the fixed wrap 53.

For example, in FIG. 3, the portion of the orbiting wrap 6 corresponding to the thick portion A of the fixed wrap 5 is composed of a curve 1' C1' of the outer curve and a curve 9' C9' and a curve 10' C10' of the inner curve. Therefore, when the curve 1 C1 of the thick portion A of the fixed wrap 5 is offset by a predetermined distance e in the direction of thinning the thick portion A as described above, the curve 1' C1' of the outer curve of the orbiting wrap 6 corresponding to the curve 1 C1 of the fixed wrap 5 is also offset by the predetermined distance in the same direction as illustrated in FIG. 5. In reference, in FIG. 5, the solid line represents the orbiting wrap 63 according to the present disclosure in which the conventional orbiting wrap 6 is offset to correspond to the offset fixed wrap 53, and the imaginary line (two-dot chain line) represents the conventional orbiting wrap 6 that is not offset.

At this time, when the curve 6' C6', which is the outer curve of the center portion of the orbiting wrap 6, is simultaneously offset by the predetermined distance, the thickness of the center portion of the orbiting wrap 6 formed by the curve 1' C1' and the curve 6' C6' is not changed and only the thickness of the suction portion S2 may be made thick from t2 to t2'.

Figure 5:
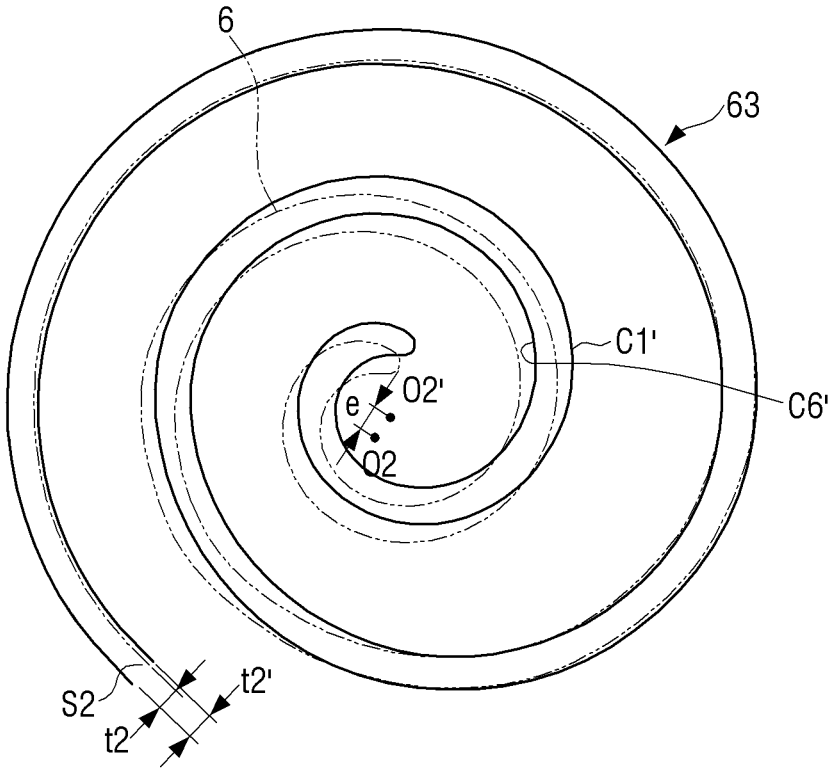
FIG. 5 is a view illustrating a comparison between an orbiting wrap of an orbiting scroll of a scroll compressor according to an embodiment of the present disclosure and an orbiting wrap of an orbiting scroll of a conventional scroll compressor.

Further, when any one of the plurality of curves constituting the hybrid curve is shifted by the offset amount, the other curves are moved correspondingly by the connection condition of the hybrid curve, so that the thickness t2' of the suction portion S2 of the orbiting wrap 63 is increased as illustrated in FIG. 5.

On the other hand, when the curve 1' C1' is moved, the center of the curve 1' C1' is moved. In the case of the present embodiment, since the curve 1' C1' is an involute curve, the center of the involute curve is moved. Therefore, the center O2' of the curve C1' of the center portion of the orbiting wrap 63 of the orbiting scroll 60 of the scroll compressor 1 according to an embodiment of the present disclosure does not coincide with the center O2 of the orbiting scroll 60 and is shifted by the distance by which the curve C1' of the center portion is moved, that is, the offset amount e.

Figure 6:
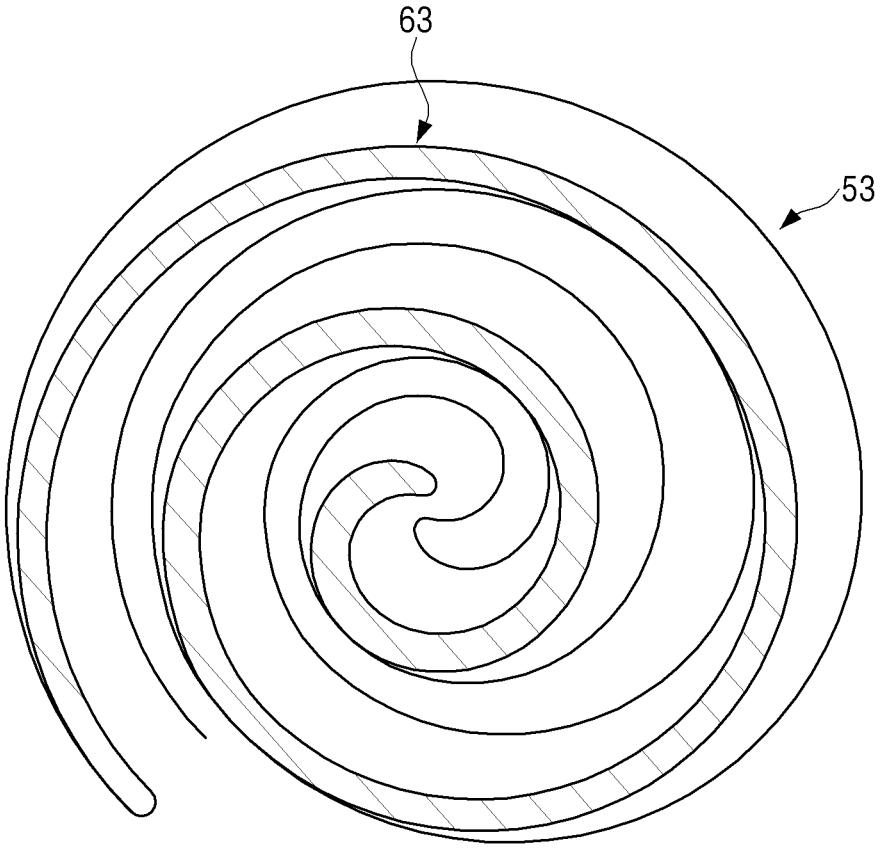
FIG. 6 is a cross-sectional view illustrating a state where the fixed wrap of the fixed scroll of FIG. 4 and the orbiting wrap of the orbiting scroll of FIG. 5 are engaged with each other.

The state in which the fixed wrap 53 in which the center curve is offset by the predetermined distance in the direction of thinning the thick portion A as illustrated in FIG. 4 and the orbiting wrap 63 in which the center curve is offset corresponding to the fixed wrap 53 as illustrated in FIG. 5 are engaged with each other is illustrated in FIG. 6.

As illustrated in FIG. 6, when the thickness of the thick portion A of the fixed wrap 53 is slightly reduced and the thin suction portions S1 and S2 are thickened, the fixed wrap 53 of the fixed scroll 50 and the orbiting wrap 63 of the orbiting scroll 60 are reinforced. Therefore, the reliability of the scroll compressor 1 may be improved when the scroll compressor 1 is rotated at a high speed or when the liquid refrigerant is introduced.

FIG. 7 is a table illustrating examples of formulas of a curve of a center portion and an amount of movement of a center when a curve of the center portion of a hybrid curve forming a fixed scroll and an orbiting scroll of a scroll compressor according to an embodiment of the present disclosure is an involute curve and a logarithmic spiral curve.

In FIG. 7, FS denotes the fixed scroll, and OS denotes the orbiting scroll. Inner represents the inner curve of the center portion of the fixed scroll, and Outer represents the outer curve of the center portion of the orbiting scroll corresponding to the inner curve of the fixed scroll. Further, ε represents the eccentric distance of the orbiting scroll.

As can be seen from FIG. 7, the center of the curve of the center portion of the fixed wrap of the fixed scroll of the conventional scroll compressor coincides with the center of the fixed scroll. The center of the curve of the center portion of the orbiting wrap of the orbiting scroll of the conventional scroll compressor also coincides with the center of the orbiting scroll.

However, the center of the curve of the center portion of the fixed wrap of the fixed scroll of the scroll compressor according to an embodiment of the present disclosure does not coincide with the center of the fixed scroll. In other words, the center of the curve of the center portion of the fixed scroll is located at a position of the coordinates (m, n) in the X-Y coordinate system when the center of the fixed scroll is the origin point. Thus, the distance from the center of the fixed scroll to the center of the curve of the center portion of the fixed wrap is $\sqrt{m^2+n^2}$.

Also, the center of the curve of the center portion of the orbiting wrap of the orbiting scroll of the scroll compressor according to an embodiment of the present disclosure does not coincide with the center of the orbiting scroll. In other words, the center of the curve of the center portion of the orbiting scroll is located at a position of the coordinates (m, n) in the X-Y coordinate system when the center of the orbiting scroll is the origin point. Thus, the distance from the center of the orbiting scroll to the center of the curve of the center portion of the orbiting wrap is $\sqrt{m^2+n^2}$.

Hereinafter, as another embodiment of the present disclosure, the case where the fixed wrap of the fixed scroll and the orbiting wrap of the orbiting scroll are formed by hybrid curves formed by only a plurality of arcs will be described with reference to FIG. 8.

Figure 8:
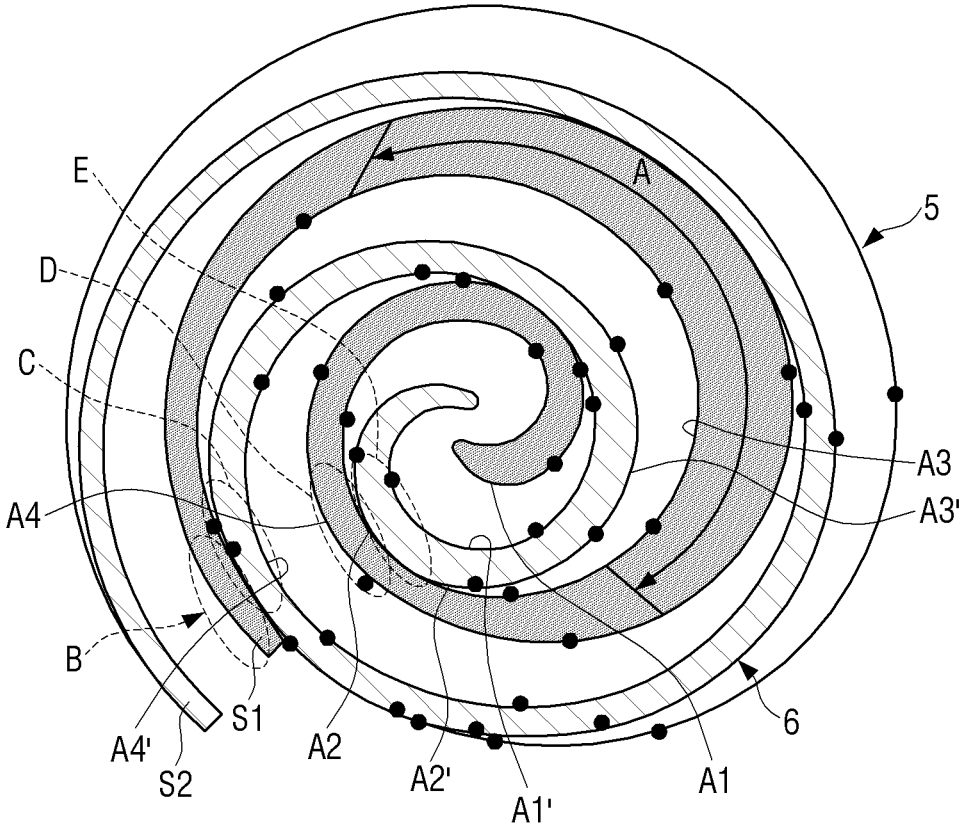
FIG. 8 is a cross-sectional view illustrating a case where a fixed wrap of a fixed scroll of a scroll compressor and an orbiting wrap of an orbiting scroll are hybrid wraps formed by a plurality of arcs.

FIG. 8 is a cross-sectional view illustrating a case where a fixed wrap of a fixed scroll of a scroll compressor and an orbiting wrap of an orbiting scroll are hybrid wraps formed by a plurality of arcs.

Referring to FIG. 8, a fixed wrap 5 has a thick portion A, which is thicker than the thicknesses of the center portion and the outer portion, in the middle portion. In order to increase the thickness of a suction portion S1 of the fixed wrap 5, it is necessary to move the curve forming the thick portion A in the direction of thinning the thick portion A.

In FIG. 8, since the inner curve of the thick portion A of the fixed wrap 5 includes the arc 3 A3, the arc 3 A3 is moved to the right, so that the thickness of the thick portion A may be reduced and the thickness of the suction portion S1 may be increased.

Figure 9A:
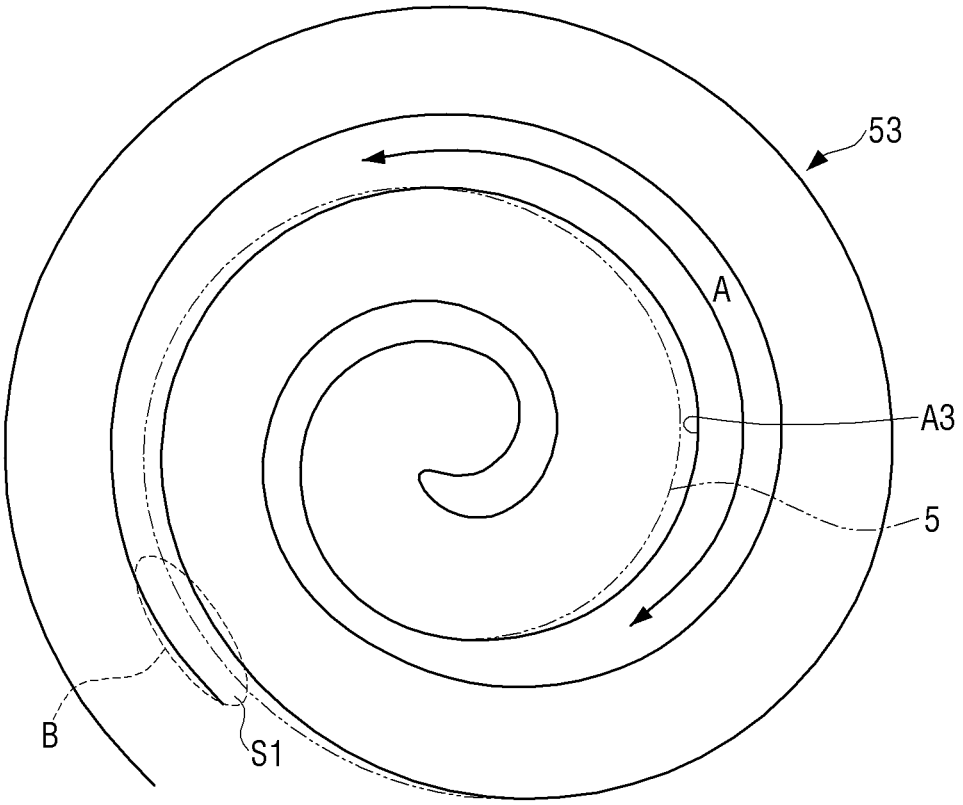
FIG. 9A is a view illustrating a case where an arc forming a thick portion of the fixed wrap of the fixed scroll of the scroll compressor of FIG. 8 is offset to the right.
Figure 9B:
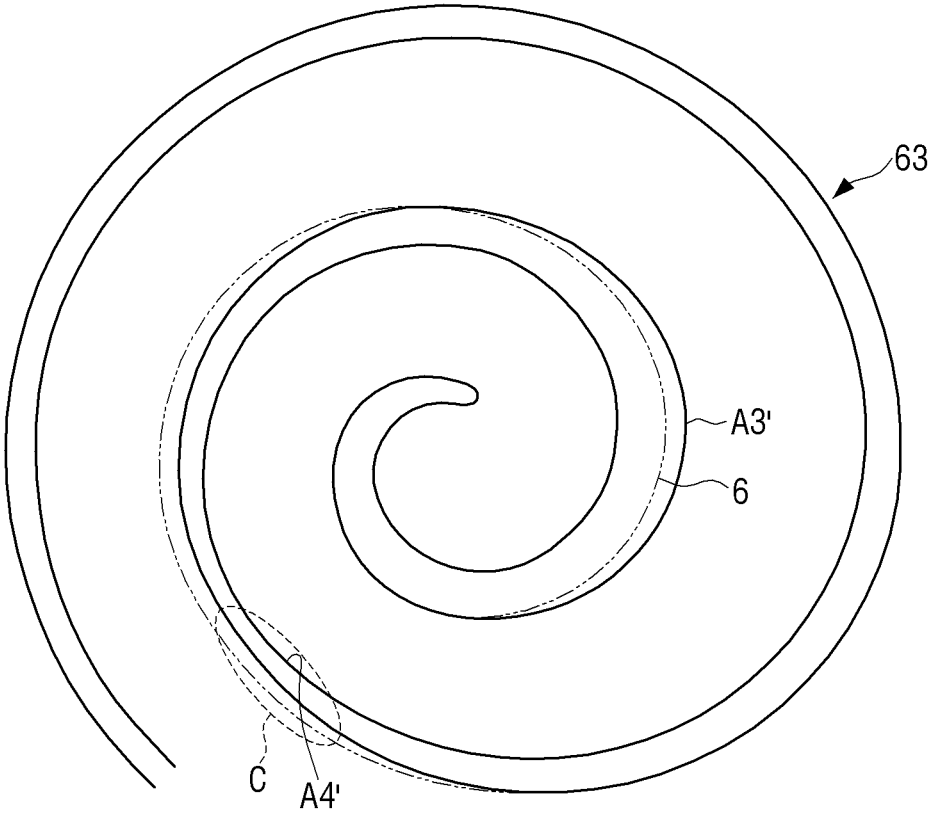
FIG. 9B is a view illustrating a case where an arc of the orbiting wrap of the orbiting scroll corresponding to the arc of the fixed wrap of the offset fixed scroll of FIG. 9A is offset to the right.

FIG. 9A is a view illustrating a case where an arc forming a thick portion of the fixed wrap of the fixed scroll of the scroll compressor of FIG. 8 is offset to the right, and FIG. 9B is a view illustrating a case where an arc of the orbiting wrap of the orbiting scroll corresponding to the arc of the fixed wrap of the offset fixed scroll of FIG. 9A is offset to the right. In reference, in FIG. 9A, the solid line represents the fixed wrap 53 according to the present disclosure in which the conventional fixed wrap 5 is offset in the direction of thinning the thick portion A, and the imaginary line (two-dot chain line) represents the conventional fixed wrap 5 in which the thick portion A is not offset. Also, in FIG. 9B, the solid line represents the orbiting wrap 63 according to the present disclosure in which the conventional orbiting wrap 6 is offset to correspond to the offset fixed wrap 53, and the imaginary line (two-dot chain line) represents the conventional orbiting wrap 6 that is not offset.

For example, as illustrated in FIG. 9A, when the arc 3 A3, which is one of the curves of the thick portion A of the fixed wrap 53, is offset by a predetermined distance in the direction in which the thickness of the thick portion A is reduced, that is, to the right side, the portion B of the fixed wrap 53 becomes thick. At this time, the arc 3' A3' forming the portion of the orbiting wrap 63 corresponding to the thick portion A of the fixed wrap 53 is also offset by the predetermined distance as illustrated in FIG. 9B. Thus, as illustrated in FIG. 9B, the C portion of the orbiting wrap 63 is thinned.

In order to maintain the C portion of the orbiting wrap 63 in its original thickness, the arc 4' A4 of the orbiting wrap 63 corresponding to the C portion is offset to the right by a predetermined distance. Thus, the C portion of the orbiting wrap 63 may be made the original thickness. At this time, the arc 4 A4 of the fixed wrap 53 corresponding to the arc 4' A4' of the orbiting wrap 63 is also offset to the right. Therefore, the portion D (see FIG. 8) of the fixed wrap 53 becomes thin.

In order to maintain the D portion of the fixed wrap 53 in its original thickness, the arc 2 A2 of the fixed wrap 53 corresponding to the D portion is offset to the right side by a predetermined distance. Thus, the D portion of the fixed wrap 53 may be made the original thickness. At this time, the arc 2' A2' of the orbiting wrap 63 corresponding to the arc 2 A2 of the fixed wrap 53 is also offset to the right by the predetermined distance. Therefore, the portion E (see FIG. 8) of the orbiting wrap 63 becomes thin.

In order to maintain the E portion of the orbiting wrap 63 in its original thickness, the arc 1' A1' of the orbiting wrap 63 corresponding to the E portion is offset to the right side by a predetermined distance. Thus, the E portion of the orbiting wrap 63 may be maintained at its original thickness. At this time, the arc 1 A1 of fixed wrap 53 corresponding to the arc 1' A1' of the orbiting wrap 63 is also offset to the right. Thus, the fixed wrap 53 becomes as illustrated in FIG. 10A, and the orbiting wrap 63 becomes as illustrated in FIG. 10B.

Figure 10A:
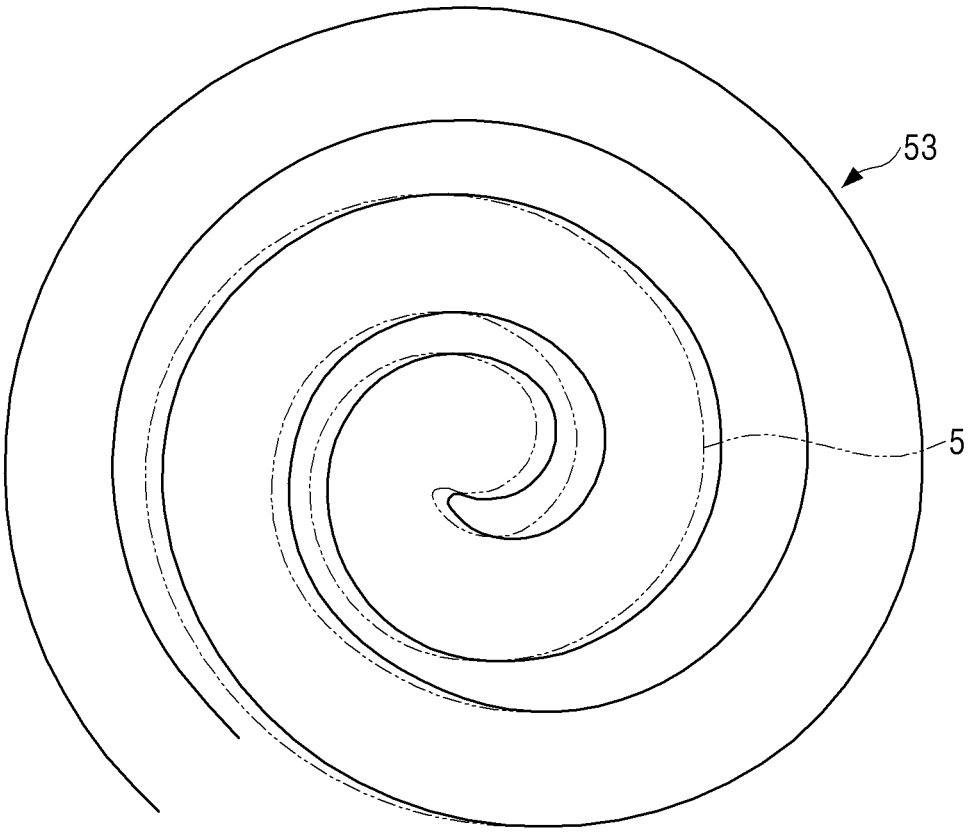
FIG. 10A is a view illustrating a case where arcs of the other portions are offset in correspondence with the offset of the arc of the thick portion of the fixed wrap of the offset fixed scroll of FIG. 9A.
Figure 10B:
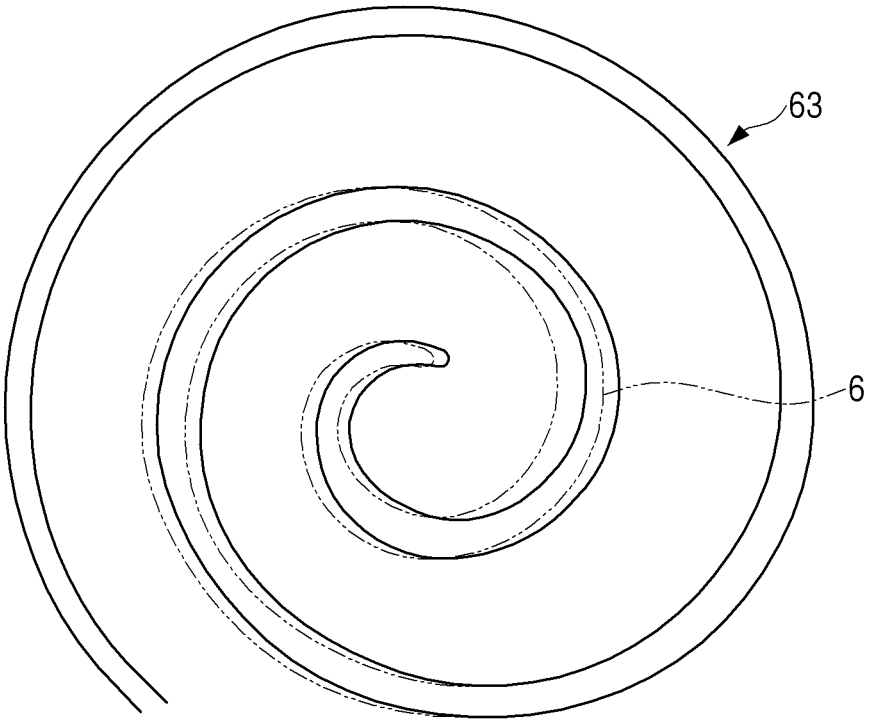
FIG. 10B is a view illustrating a case where arcs of the other portions forming the orbiting wrap of the orbiting scroll is offset so as to correspond to the fixed wrap of the offset fixed scroll of FIG. 10A.

Here, FIG. 10A is a view illustrating a case where arcs of the other portions are offset in correspondence with the offset of the arc of the thick portion A of the fixed wrap 53 of the fixed scroll 50 of FIG. 9A, and FIG. 10B is a view illustrating a case where arcs of the other portions forming the orbiting wrap 63 of the orbiting scroll 60 are offset so as to correspond to the fixed wrap of the offset fixed scroll 53 of FIG. 10A. In reference, in FIG. 10A, the solid line represents the fixed wrap 53 according to the present disclosure in which the conventional fixed wrap 5 is offset in the direction of thinning the thick portion A, and the imaginary line (two-dot chain line) represents the conventional fixed wrap 5 in which the thick portion A is not offset. Also, in FIG. 10B, the solid line represents the orbiting wrap 63 according to the present disclosure in which the conventional orbiting wrap 6 is offset to correspond to the offset fixed wrap 53, and the imaginary line (two-dot chain line) represents the conventional orbiting wrap 6 that is not offset.

Therefore, the thickness of the thick portion A of the fixed wrap 53 is reduced, but the thicknesses of the center portion and the outer portion are kept to be close to their thicknesses before the curve of the thick portion A is offset to the right and the thickness of the suction portion (B portion) is increased. The orbiting wrap 63 may keep the thickness before the orbiting wrap 63 is offset to the right to correspond to the curve of the thick portion A of the fixed wrap 53 as a whole.

As described above, according to an embodiment of the present disclosure, by appropriately offsetting a plurality of curves forming the hybrid curve in the direction of thinning the thick portion A of the fixed wrap 53, the thinnest wrap portion may be designed to have a desired thickness while maintaining the compression capacity as it is.

In the above description, the thickness of the suction portion S1 located at the outermost portion of the fixed wrap 53 is increased, but the present disclosure may also be used to increase the thickness of the center portion of the fixed wrap 53.

Figure 11A:
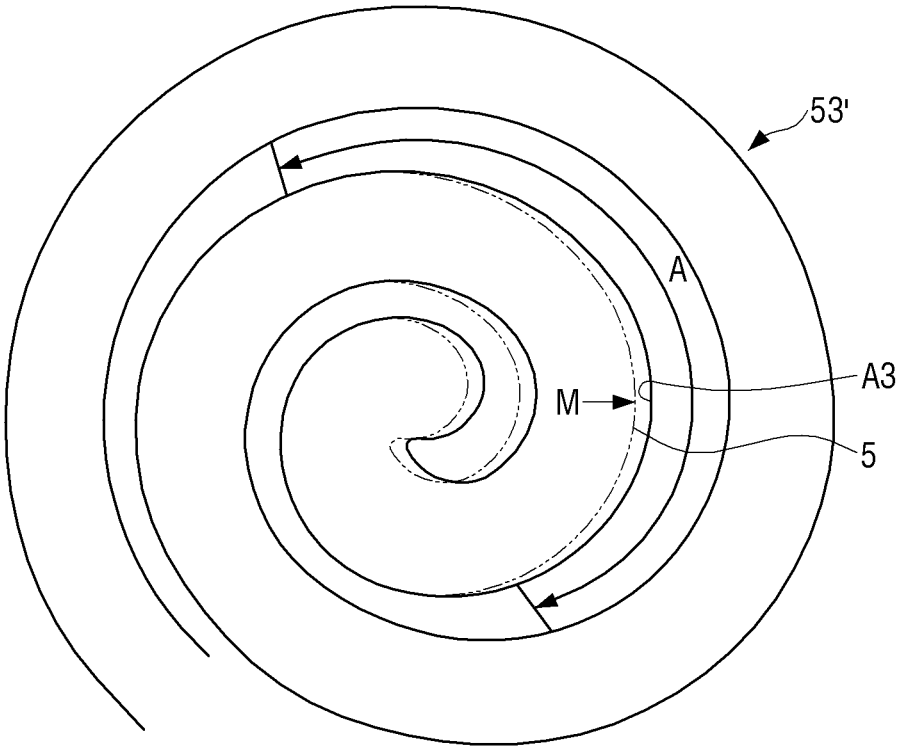
FIG. 11A is a view illustrating a case where an inner curve of the thick portion of the fixed wrap is offset to increase the thickness of a center portion of the fixed wrap of the fixed scroll in the scroll compressor of FIG. 8.
Figure 11B:
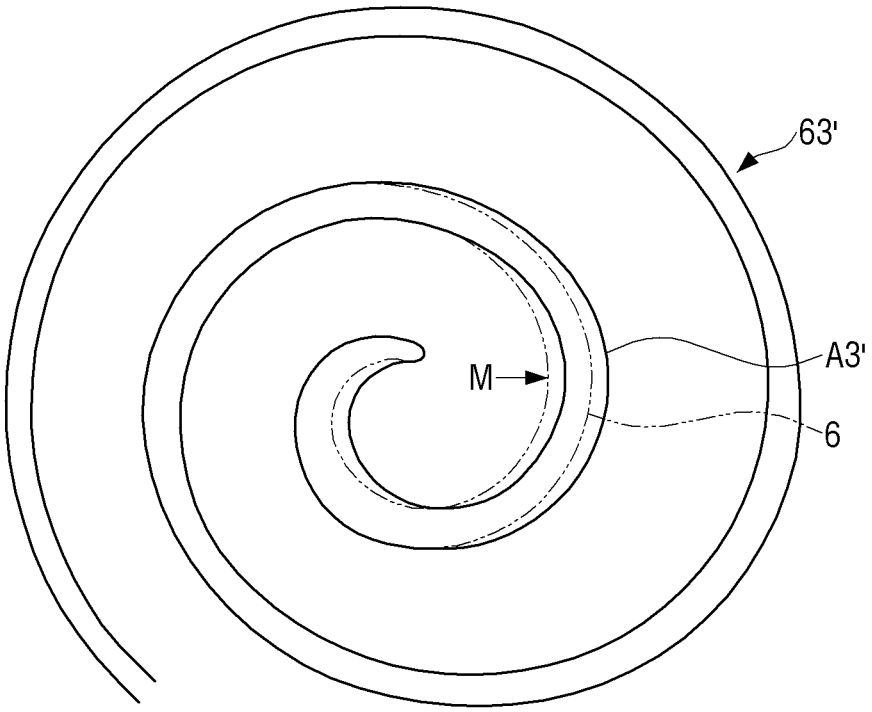
FIG. 11B is a view illustrating the orbiting wrap of the orbiting scroll which is offset corresponding to the offset of the fixed scroll of FIG. 11A.

FIG. 11A is a view illustrating a case where an inner curve of the thick portion of the fixed wrap is offset to increase the thickness of a center portion of the fixed wrap of the fixed scroll in the scroll compressor of FIG. 8, and FIG. 11B is a view illustrating the orbiting wrap of the orbiting scroll which is offset corresponding to the offset of the fixed scroll of FIG. 11A.

As illustrated in FIG. 11A, the curve A3 forming the inner curve of the thick portion A of the fixed wrap 5 is offset by a predetermined distance in the direction in which the thickness of the thick portion A of the fixed wrap 5 is reduced and the thickness of the center portion is increased, for example, to the right (direction of arrow M) in FIG. 11A, the fixed wrap 53' the thickness of the center portion of which is increased may be obtained. In reference, in FIG. 11A, the solid line represents the fixed wrap 53' according to the present disclosure in which the conventional fixed wrap 5 is offset in the direction in which the thick portion A is thinned and the center portion is thickened, and the imaginary line (two-dot chain line) represents the conventional fixed wrap 5 in which the thick portion A is not offset.

Further, the orbiting wrap 63' is offset to correspond to the offset fixed wrap 53'. For example, as illustrated in FIG. 11B, when the curve A3' of the orbiting wrap 6 corresponding to the curve A3 of the thick portion A of the fixed wrap 5 is offset by a predetermined distance to the right (direction of arrow M), the thickness of the center portion of the orbiting wrap 63' may be increased. Also, in FIG. 11B, the solid line represents the orbiting wrap 63' according to the present disclosure in which the conventional orbiting wrap 6 is offset to correspond to the offset fixed wrap 53', and the imaginary line (two-dot chain line) represents the conventional orbiting wrap 6 that is not offset.

As described above, the scroll compressor according to an embodiment of the present disclosure may be formed by designing to maximize the compression capacity by using a hybrid wrap and then offsetting the center of the curve of the center portion in the direction in which the thickness of the thick portion of the fixed wrap is reduced and the thickness of the thin portion thereof is increased.

Therefore, with the scroll compressor according to an embodiment of the present disclosure, the thickness of the relatively thin portion may be increased while reducing the thickness of the portion of the fixed wrap which is thicker than necessary, so that the compression capacity of the scroll compressor may be maintained and the thickness of the thin portion may be increased. Therefore, occurrence of cracks in the fixed scroll and the orbiting scroll may be prevented, thereby improving the reliability of the scroll compressor.

While the embodiments of the present disclosure have been described, additional variations and modifications of the embodiments may occur to those skilled in the art once they learn of the basic inventive concepts. Therefore, it is intended that the appended claims shall be construed to include both the above embodiments and all such variations and modifications that fall within the spirit and scope of the inventive concepts.

What is claimed is:

1. A scroll compressor comprising:

a fixed scroll including a fixed mirror-like surface and a fixed wrap that is extended from the fixed mirror-like surface, is formed in a first hybrid curve, and includes a center portion, a thick portion extending radially outward from the center portion and a suction portion extending radially outward from the thick portion, the thick portion being that is thicker than the center and suction portions, a thickness of the thick portion depending on a center of a curve of the center portion;

an orbiting scroll including an orbiting mirror-like surface and an orbiting wrap that is extended from the orbiting mirror-like surface and is formed in a second hybrid curve; and a rotating shaft configured to rotate the orbiting scroll, wherein the orbiting scroll revolves relative to the fixed scroll, wherein the center of the curve of the center portion of the fixed wrap is located at a position that is radially offset from a center of the fixed mirror-like surface by a predetermined distance in a direction of reducing the thickness of the thick portion of the fixed wrap while still maintaining the thick portion of the fixed wrap to be thicker than the center and suction portions of the fixed wrap, wherein a center of a curve of a center portion of the orbiting wrap is offset to correspond to the fixed wrap, and wherein the center of the curve of the center portion of the fixed wrap is radially offset from the center of the fixed mirror-like surface by ½ or less of an eccentric distance between a center line of the rotating shaft and a center of the orbiting mirror-like surface of the orbiting scroll.

2. The scroll compressor of claim 1, wherein the center of the curve of the center portion of the fixed wrap is located at a position that is offset from the center of the fixed mirror-like surface in a direction in which the thickness of the thick portion of the fixed wrap is reduced and the thickness of a suction portion of the fixed wrap is increased.

3. The scroll compressor of claim 1, wherein each of the first hybrid curve and the second hybrid curve comprises an involute curve, at least one multidimensional curve, and at least one arc connected sequentially outward from the center portion.

4. The scroll compressor of claim 1, wherein each of the first hybrid curve and the second hybrid curve comprises a logarithmic spiral curve, at least one multidimensional curve, and at least one arc connected sequentially outward from the center portion.

5. The scroll compressor of claim 1, wherein each of the first hybrid curve and the second hybrid curve comprises at least one multidimensional curve and at least one arc connected sequentially outward from the center portion.

6. The scroll compressor of claim 1, wherein each of the first hybrid curve and second hybrid curve is formed by combining a plurality of multidimensional curves.

7. The scroll compressor of claim 1, wherein each of the first hybrid curve and second hybrid curve is formed by combining a plurality of arcs.

8. The scroll compressor of claim 1, wherein the center of the curve of the center portion of the fixed wrap is located at a position that is offset from the center of the fixed mirror-like surface in a direction in which the thickness of the thick portion of the fixed wrap is reduced and the thickness of the center portion of the fixed wrap is increased.

9. A scroll compressor comprising:

a first scroll including a fixed mirror-like surface and a first wrap extended from the fixed mirror-like surface;

a second scroll including an orbiting mirror-like surface and a second wrap extended from the orbiting mirror-like surface; and a rotating shaft configured to cause the second scroll to revolve relative to the first scroll, wherein the first wrap is formed of an inner curve and an outer curve which are hybrid curves and includes a center portion, a middle portion radially outward from the center portion and a suction portion radially outward from the middle portion, the middle portion being thicker than the suction portion, each of the center portion, the middle portion and the suction portion being formed from respective sections of the inner curve and the outer curve, the section of the inner curve forming the center portion being positioned together with the section of the inner curve forming the middle portion, wherein a center of the section of the inner curve forming the center portion of the first wrap is radially offset by a predetermined distance from a center of the fixed mirror-like surface so that the section of the inner curve forming the middle portion of the first wrap is offset toward the section of the outer curve forming the middle portion, wherein the second wrap includes an inner curve and an outer curve which are hybrid curves, and is formed to correspond to the inner curve of the first wrap, and wherein the center of the section of the inner curve forming the center portion of the first wrap is radially offset from the center of the fixed mirror-like surface by ½ or less of an eccentric distance between a center line of the rotating shaft and a center of the orbiting mirror-like surface of the orbiting scroll.

10. The scroll compressor of claim 9, wherein the center of the section of the inner curve forming the center portion of the first wrap is located at a position that is offset from the center of the fixed mirror-like surface in a direction in which a thickness of the middle portion of the first wrap is reduced and a thickness of a suction portion of the first wrap is increased, while still maintaining the middle portion of the first wrap to be thicker than the suction portion of the first wrap.

11. The scroll compressor of claim 9, wherein the hybrid curve forming each of the inner curve of the first wrap and the outer curve of the second wrap comprises an involute curve, at least one multidimensional curve, and at least one arc connected sequentially outward from the center portion.

12. The scroll compressor of claim 9, wherein the hybrid curve forming each of the inner curve of the first wrap and the outer curve of the second wrap comprises a logarithmic spiral curve, at least one multidimensional curve, and at least one arc connected sequentially outward from the center portion.

13. The scroll compressor of claim 9, wherein the center of the section of the inner curve forming the center portion of the first wrap is located at a position that is offset from the center of the fixed mirror-like surface in a direction in which a thickness of the middle portion of the first wrap is reduced and a thickness of the center portion of the first wrap is increased, while still maintaining the middle portion of the first wrap to be thicker than the suction portion of the first wrap.

* * * * *